United States Patent [19]

Escobar, Jr. et al.

[11] Patent Number: 4,946,520

[45] Date of Patent: Aug. 7, 1990

[54] COPPER ROD MANUFACTURED BY CASTING, HOT ROLLING AND CHEMICALLY SHAVING AND PICKLING

[75] Inventors: Benjamin A. Escobar, Jr.; Lester J. Wahner; Gilbert Montes; John T. Farraro, all of El Paso, Tex.

[73] Assignee: Phelps Dodge Industries, Inc., New York, N.Y.

[21] Appl. No.: 213,221

[22] Filed: Jun. 29, 1988

Related U.S. Application Data

[62] Division of Ser. No. 9,775, Feb. 2, 1987, Pat. No. 4,754,803.

[51] Int. Cl.[5] ..... C22C 9/00

[52] U.S. Cl. ..... 148/432; 420/469

[58] Field of Search ..... 148/432; 420/469

[56] References Cited

U.S. PATENT DOCUMENTS

| | | | |
|---|---|---|---|
| 2,428,804 | 10/1947 | Terry et al. | 252/100 |
| 2,678,876 | 5/1954 | Burnside . | |
| 2,856,275 | 10/1958 | Otto . | |
| 2,965,521 | 12/1960 | Bomberger et al. | 134/3 |
| 3,345,225 | 10/1967 | Lacal . | |
| 3,463,733 | 8/1969 | Achenbach | 252/79.4 |
| 3,537,895 | 11/1970 | Lancy | 134/3 |
| 3,589,430 | 6/1971 | Barrow et al. | 164/476 |
| 3,623,532 | 11/1971 | Cofer et al. | 164/476 |
| 3,903,244 | 9/1975 | Winkley | 423/272 |
| 3,905,907 | 9/1975 | Shiga | 252/79.4 |
| 4,040,863 | 8/1977 | Kitamura | 134/3 |
| 4,051,057 | 9/1977 | Ericson et al. | 252/100 |
| 4,086,176 | 4/1978 | Ericson et al. | 252/100 |
| 4,175,011 | 11/1979 | Spiliotis | 204/15 |
| 4,220,706 | 9/1980 | Spak | 430/318 |
| 4,236,957 | 12/1980 | Valayil et al. | 156/666 |
| 4,401,509 | 8/1983 | Schellinger, Jr. | 156/666 |
| 4,443,268 | 4/1984 | Cook | 134/2 |
| 4,459,216 | 7/1984 | Nakazato et al. | 252/79.4 |
| 4,510,018 | 4/1985 | McGowan | 156/666 |
| 4,545,918 | 10/1985 | Pralus | 252/142 |

FOREIGN PATENT DOCUMENTS

| | | | |
|---|---|---|---|
| 1435789 | 5/1976 | United Kingdom | 29/527.7 |

OTHER PUBLICATIONS

Chia, E. H. et al., "Torsional Stress Tests for Copper Rod: Indicator of Quality and Performance," *Wire Journal International*, Jun. 1986, pp. 57–67.

Pops, H. et al., "The Role of Surface Oxide and Its Measurement in the Copper Wire Industry," *Wire Journal*, Apr. 1977, pp. 50–57.

*Primary Examiner*—Richard K. Seidel
*Assistant Examiner*—J. Reed Batten, Jr.
*Attorney, Agent, or Firm*—Donald E. Degling; Leon R. Yankwich; Steven C. Bauman

[57] ABSTRACT

Copper rod has an improved surface smoothness and substantially no surface oxides, which rod is suitable for drawing or rolling into wire. The copper rod is produced by a process which comprises the steps of forming a bath of molten pure copper, casting the molten copper into a cast bar, conditioning the bar for hot-rolling, hot-rolling the bar to form a hot-rolled rod, cooling the hot-rolled rod and chemically shaving and pickling the hot-rolled rod. The chemical shaving and pickling step is performed with a solution containing controlled concentrations of sulfuric acid and hydrogen peroxide. Both the solution and the rod are maintained at elevated temperatures and the duration of the reaction is controlled. The interrelated process variables are regulated so that substantially all of the surface oxides and a desired amount of copper are removed from the surface of the hot-rolled rod.

7 Claims, 3 Drawing Sheets

COPPER ROD MANUFACTURED BY CASTING, HOT ROLLING AND CHEMICALLY SHAVING AND PICKLING

This is a division of application Ser. No. 009,775, filed Feb. 2, 1987, and now U.S. Pat. No. 4,754,803, issued July 5, 1988.

BACKGROUND OF THE INVENTION

1. Field Of The Invention

This invention relates generally to a chemical shaving and pickling process for use in the manufacture of cast copper rod. More particularly, it relates to a process for chemical shaving and pickling employing a combination of sulfuric acid and hydrogen peroxide operated under controlled time, temperature, and concentration conditions so as to provide an improved surface substantially free of surface oxides for continuously cast copper rod destined for subsequent wire drawing or rolling operations.

2. Discussion Of The Prior Art

For many years, copper rod which is intended to be drawn into wire has been prepared by statically or continuously casting electrolytically refined copper into cast wire bar or continuously cast bar, respectively; conditioning the cast bar for rolling; rolling the cast bar in a hot-reversing or multiple stand hot mill to an intermediate size; further rolling in a multiple-pass rolling process to a desired hot-rolled size; and coiling the hot-rolled rod. As a result of the casting, conditioning, and hot-rolling operations, oxide scale forms on the surface of the rod. The scale may include cuprous oxide ($Cu_2O$) and cupric oxide (CuO). In order to remove the scale in preparation for the subsequent drawing or rolling process, it is necessary to add a pickling step following hot rolling. While the pickling may be performed in a batch process by dipping the coiled rod in an appropriate solution for a predetermined time period, it is also possible, and frequently desirable, to employ a continuous pickling process, such as the so-called "Dr. Otto" pickling system, wherein loops of copper rod from the coil are passed sequentially through pickling, rinsing, and coating tanks on a continuous conveyor. A number of pickling solutions have been used in the past including aqueous solutions containing sodium bichromate, hydrogen peroxide, and sulfuric or other acids or combinations thereof. Sodium bichromate and hydrogen peroxide are oxidizers while sulfuric acid and other acids function as reducing agents. Sodium bichromate is not a practical pickling agent for copper because the copper with which it reacts cannot easily be recovered and the products of reaction cause pollution problems. Where sulfuric acid ($H_2SO_4$) is used as the active agent in an aqueous pickling solution, commonly at a concentration of about 20% and a temperature of about 120°–180° F., the principal reaction is:

$$CuO+H_2SO_4 \rightarrow CuSO_4(aq.)+H_2O \quad (1)$$

though the following reaction also occurs to a limited degree:

$$Cu_2O+H_2SO_4 \rightarrow CuSO_4(aq.)+H_2O+Cu. \quad (2)$$

The second reaction, involving cuprous oxide ($Cu_2O$), produces a red copper powder which should be completely removed from the rod before drawing commences. Experience with this reaction has shown, however, that sulfuric acid alone does not remove all of the red cuprous oxide and that, over time, some of the remaining red cuprous oxide further oxidizes to a black cupric oxide.

In order to improve the effectiveness of sulfuric acid pickling, hydrogen peroxide ($H_2O_20$ has been added to the aqueous pickling solution since hydrogen peroxide is effective to oxidize cuprous oxide ($Cu_2O$) to cupric oxide (CuO) according to the following reaction:

$$Cu_2O+H_2O_2 \rightarrow 2CuO+H_2O. \quad (3)$$

Hydrogen peroxide can also react with metallic copper when the oxide coating has been removed but, as noted below, this reaction does not occur under ordinary acid pickling conditions. Moreover, hydrogen peroxide is relatively unstable and must be stabilized in order to provide reliable process results.

In addition to pickling processes, the art has also practiced mechanical shaving of copper rod in order to produce a clean and uniform surface. However, while mechanical shaving is effective, it is necessary to remove relatively large quantities of copper from the rod surface which increases the copper loss and the processing expense. As a result, mechanically shaved rod is a premium product which is commercially acceptable only in limited areas.

As an alternative to the usual pickling process, producers of copper rod have employed sulfuric acid cooling procedures wherein the hot-rolled copper rod is cooled with sulfuric acid between the rolling and coiling steps and then washed in order to remove the resulting red copper powder. In this process, the mechanical effect of the water and the difference between the coefficients of expansion of the copper and copper oxides help to separate mechanically the oxides from the base copper. In some cases, alcohol is substituted for sulfuric acid as a coolant and reducing agent.

Despite the various pickling, cleaning, and conditioning processes that have been developed heretofore, an economically satisfactory process for removing surface oxides and for providing an improved surface for copper rod intended for wire drawing has not been available.

SUMMARY OF THE INVENTION

The object of the present invention is to provide an improved chemical shaving and pickling process, particularly for continuously cast copper rod intended for wire drawing. It is recognized that although refined copper comparable in purity to the purity of electrolytically refined copper cathodes which is melted and then continuously cast may be pure and relatively clean prior to melting, the exposure to air during the melting, casting, conditioning, and rolling steps while the copper is at an elevated temperature results in the formation of cuprous and cupric oxides at the surface of the metal. During rolling, a portion of these oxides may be rolled into the surface of the metal rod. In accordance with the present process, the copper rod, after rolling, is passed through an aqueous chemical shaving and pickling solution containing stabilized hydrogen peroxide and sulfuric acid in controlled proportions. The temperature of the copper rod entering the shaving and pickling solution is maintained within a range of about 250°–500° F. while the shaving and pickling solution itself is maintained at a temperature in the range of 120°–160° F. and preferably 120°–140° F. The sulfuric acid concentration of the aqueous solution may be maintained in the range of 180–450 grams/liter free acid and preferably in the range of 260–340 grams/liter free acid while the hydrogen peroxide concentration varies from about 5 to about 50 grams/liter and preferably 15–28 grams/liter. The copper rod is retained in the pickling and shaving solution for a period of time ranging between about 2 seconds and 2 minutes and preferably 45–90 seconds for loop forming continuous pickling. If it is desired to perform the chemical shaving and pickling step in the cooling tube located in advance of the coiler where the residence time of the rod may be only a few seconds and as short as 2 seconds, the rod temperature will be increased toward the upper end of the temperature range of 250° to 1,200° F. The process variables are thus interrelated and are selected and adjusted so as to remove a desired amount of copper from the hot rolled rod together with substantially all the cuprous and cupric oxides that may have formed on the rod during the casting, conditioning and rolling steps. Ordinarily, the thickness of copper to be removed will fall within the range of 0.0001 to 0.0006 inches. Copper rod processed in accordance with the present invention is characterized by the fact that a minimum number of flakes, fines, and cracks and substantially no surface oxides will be observed after performing the empirical Three Die Twist Test or similar mechanical test or optical microscopy at 600 magnifications.

DESCRIPTION OF THE DRAWINGS

Further objects and advantages of the invention will become apparent from the following detailed description and the accompanying drawings in which.

DETAILED DESCRIPTION OF THE INVENTION

The manufacture of copper wire is a well-established multi-step process. The usual raw material is electrolytically refined cathodes having a high degree of purity in order to assure satisfactory conductivity of the ultimate wire product.

Figure 1:
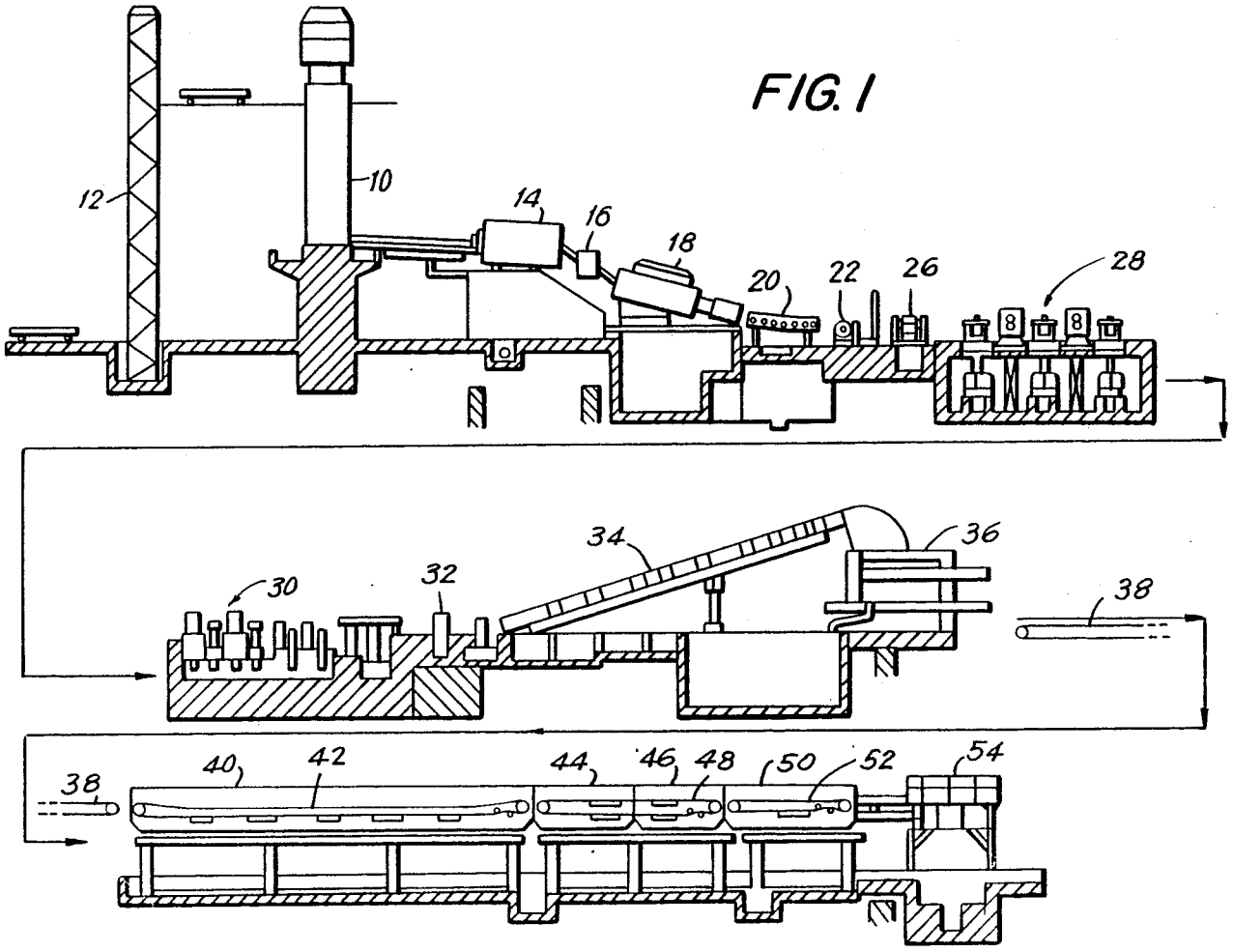
FIG. 1 is a schematic flow diagram showing the steps required to produce a continuously cast chemically shaved and pickled coil of copper rod suitable for wire drawing.

As shown in FIG. 1, cathodes or other pure copper materials are charged from a charging machine 12 into a shaft furnace 10 or other melting unit in which copper may be melted. Molten copper from the furnace 10 is then commonly laundered into a holding furnace 14 which assures a continuous supply of molten copper for the casting operation. Molten copper from the holding furnace 14 is poured and laundered into the tundish 16 of a continuous casting machine 18. The continuously cast bar emerging from the casting machine 18 passes through a cooler 20, a pinch roll 22, and a bar preparation station 26. The continuously cast bar is then directed sequentially to the rolling mill roughing stands 28, the intermediate stands 30, and the finishing mill 32. The hot-rolled rod emerging from the finishing mill 32 normally will have a surface oxide coating comprising red cuprous oxide ($Cu_2O$) and black cupric oxide (CuO) as a result of the casting, conditioning, and rolling operations which are conducted at elevated temperatures. The hot-rolled rod then enters cooling tube 34 where it is cooled with water flowing in counterflow relation to the movement of the rod and is delivered to the coiler 36. Normally, the rod is delivered to the coiler at a temperature at which it readily can be coiled. Therefore, accordance with the invention, loops seperated from the coiled rod are further cooled to provide a rod temperature entering the chemical shaving and pickling step within the range of 250°–500° F. The loops are carried by a conveyer 38 to the chemical shaving and pickling tank 40 of the pickling system and conveyed therethrough on a conveyer 42. From the chemical shaving and pickling tank 40 the separated loops of copper rod are sequentially conveyed through a cold rinse tank 44 and a hot rinse tank 46 by a conveyer 48. Following the hot rinse the separated loops of copper rod are passed through a coating or soap tank 50 on a conveyer 52 and into a coil gathering and packaging station 54. The speeds of the conveyers 38, 42, 48, and 52 are synchronized and controlled so as to provide the desired reaction time of the separated loops in the chemical shaving and pickling tank 40. It will be appreciated that by passing separated loops of the copper rod through the chemical shaving and pickling tank 40, the length of rod subject to the chemical shaving and pickling tank reactions may be a multiple of the length of the tank 40. Thus, adequate throughput may be obtained on a continuous basis without requiring an excessive tank length. Heat exchangers are provided in each of the tanks 40, 44, 46, and 50 so that the temperature of each of the solutions may be controlled to the desired level. Typically, the hot rinse tank 46 is operated at 150°–160° F. while the soap tank 50 is operated at 170°–176° F. Each tank is also provided with appropriate pumps and valves to control the solution level, the removal of spent bath solutions and the addition of make-up chemicals and solution constituents.

It will be appreciated that the packaged coils of copper rod leaving the packaging station 54 may be further processed in conventional drawing and annealing stages to produce wire of the desired size.

As has been noted above, the hot-rolled rod from the mill 32 will have cuprous and cupric oxides on its surface. Some of the oxides formed early in the rolling operation may also become rolled into the surface of the rod. Unless the oxides are substantially removed, they will interfere with the subsequent drawing operations and result in a wire product having an unsatisfactory surface. Normally, the oxides are removed by the pickling step following cooling. However, if a premium surface quality is desired, the art has employed mechanical shaving of the pickled rod as a separate operation. When mechanical shaving is resorted to, it is necessary to physically remove a surface layer in the range of 0.005 to 0.008" thickness which, for a typical 5/16"

diameter rod, produces about 8% scrap. The minimum thickness of copper removed by the mechanical shaving process is a multiple of the thickness normally required to produce a clean, smooth surface on the rod. Unfortunately, there is no known mechanical process capable of reliably and uniformly removing the copper rod surface to such a lesser degree.

Applicants, in accordance with the present invention, have provided a chemical shaving process in conjunction with the pickling operation which removes not only substantially all of the cuprous and cupric oxides but also the surface imperfections caused, at least in part, by those oxides during mechanical processing of the rod. The present process employs an aqueous chemical shaving and pickling solution containing amounts of sulfuric acid, for example, in the range of 180 to 450 grams/liter free acid and preferably in the range of 260 to 340 grams/liter free acid to which is added hydrogen peroxide in amounts varying from 5 to about 50 grams/liter and preferably 15 to 28 grams/liter. The aqueous pickling solution is maintained at a temperature in the range of 120° to 160° F. and preferably 120° to 140° F. Under these conditions, the following chemical reactions occur:

$$2Cu+H_2O_2 \rightarrow Cu_2O+H_2O \quad (4)$$

$$Cu_2O+H_2O_2 \rightarrow 2CuO+H_2O \quad (5)$$

$$CuO+H_2SO_4 \rightarrow CuSO_4(aq.)+H_2O. \quad (6)$$

Hydrogen peroxide is a strong oxidizer and is capable of oxidizing copper to cuprous oxide ($Cu_2O$) and further oxidizing the cuprous oxide to cupric oxide (CuO) while sulfuric acid is capable of reducing the cupric oxide to dissolved copper, although it is not effective for reducing the cuprous oxide. By controlling the chemical shaving and pickling solution temperature and the entering temperature of the copper rod as well as the concentration of the hydrogen peroxide, the concentration of the sulfuric acid, and the reaction time, applicants are able to reduce substantially all of the copper oxides and chemically shave a desired quantity of the rod surface so as to produce a clean and smooth surface which is well suited for subsequent drawing or rolling operations.

It will be seen from reactions (4) and (5) above that hydrogen peroxide is consumed by oxidizing copper first to the cuprous state and second to the cupric state. Further, it will be seen that the sulfuric acid reaction (6) results in a build-up of metallic copper ions in the chemical shaving and pickling solution. In order to maintain uniform and consistent reactions, it is therefore desirable to add make-up acid and peroxide and to bleed off a stream of the copper sulfate-containing solution. Sulfuric acid can be regenerated from the bleed-off stream for reuse in the process by electroplating copper from the bleed-off stream using insoluble anodes. This operation conveniently may be accomplished in the electrolytic refining plant which produces the cathodes used as the raw material for the rod-making operation.

It will be appreciated that the process variables outlined above are all interrelated and must be controlled carefully to produce chemically shaved and pickled copper rod in accordance with the present invention in the most economical manner. Certain of these interrelationships are set forth in FIGS. 2 through 5 which report the results of a series of laboratory measurements.

Figure 2:
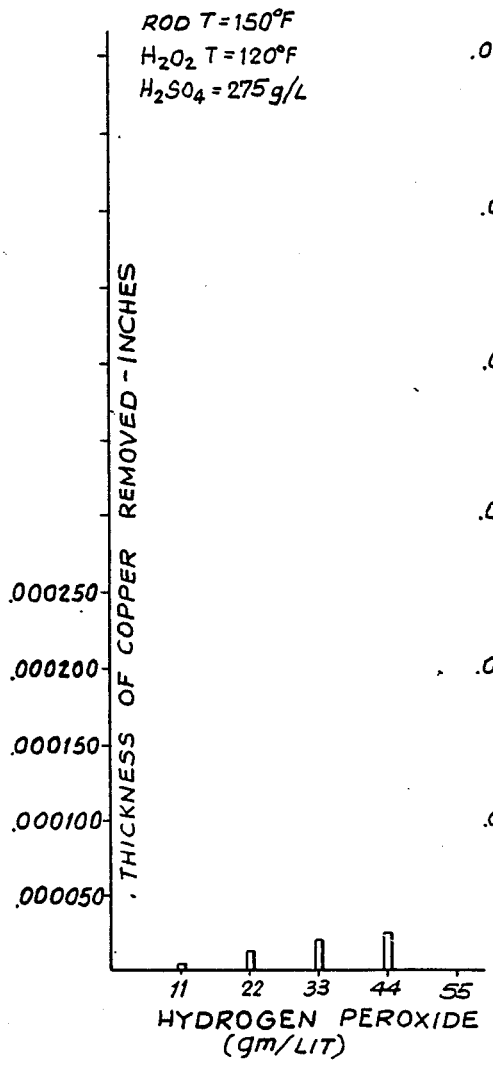
FIG. 2 is a graph showing copper removal from a polished test specimen as a function of hydrogen peroxide level using a standard sulfuric acid concentration and a conventional rod temperature of 150° F.

FIG. 2 is a graph in which the ordinate is the thickness of copper removed from the surface of a 0.428" diameter polished rod at the usual temperature of 150° F. and held for 70 seconds in a bath containing 275 grams/liter free acid of sulfuric acid at a solution temperature of 120° F. The abscissa is the concentration in grams/liter of hydrogen peroxide in the solution. The 70-second time period was chosen as the practical period for chemical shaving and pickling in the commercial continuous pickling equipment installed at the plants of applicants' assignee. It will be understood that this time restraint would not necessarily apply to a batch shaving and pickling operation and could be alleviated by the installation of additional continuous shaving and pickling equipment. FIG. 2 demonstrates that the amount of copper removed is proportional to the hydrogen peroxide concentration. However, the conditions of FIG. 2, incorporating the usual rod temperatures employed in the rod-forming process and typical solution temperatures for pickling, although effective to remove the oxides, would not remove most of the surface imperfections on the rod resulting from, for example, rolled in oxides.

Figure 3:
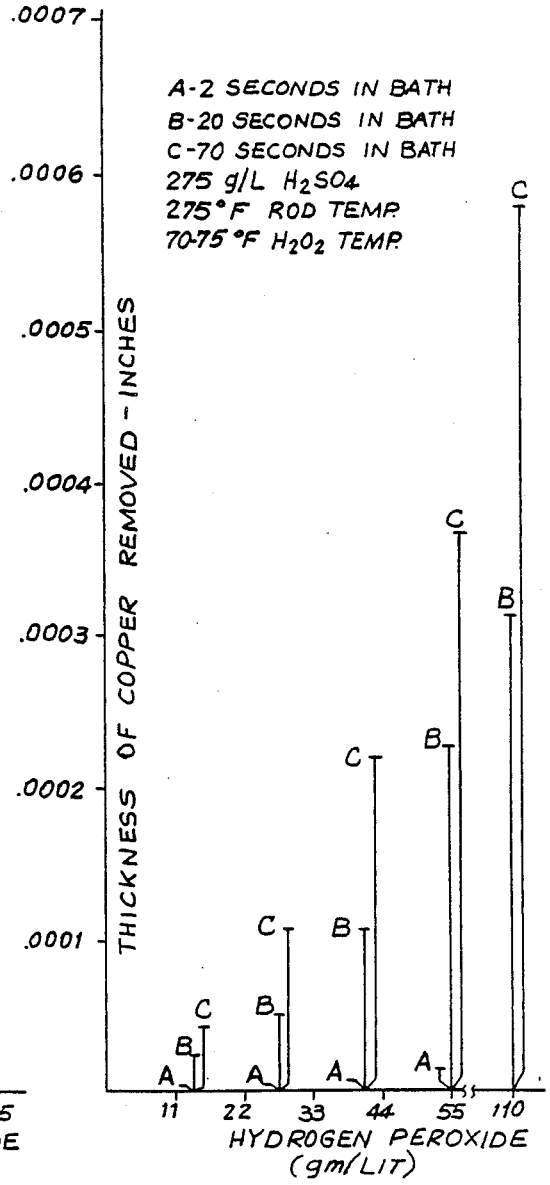
FIG. 3 is a graph showing copper removal from a polished test specimen as a function of hydrogen peroxide level with a standard sulfuric acid concentration and an elevated rod temperature of 275° F.
Figure 4:
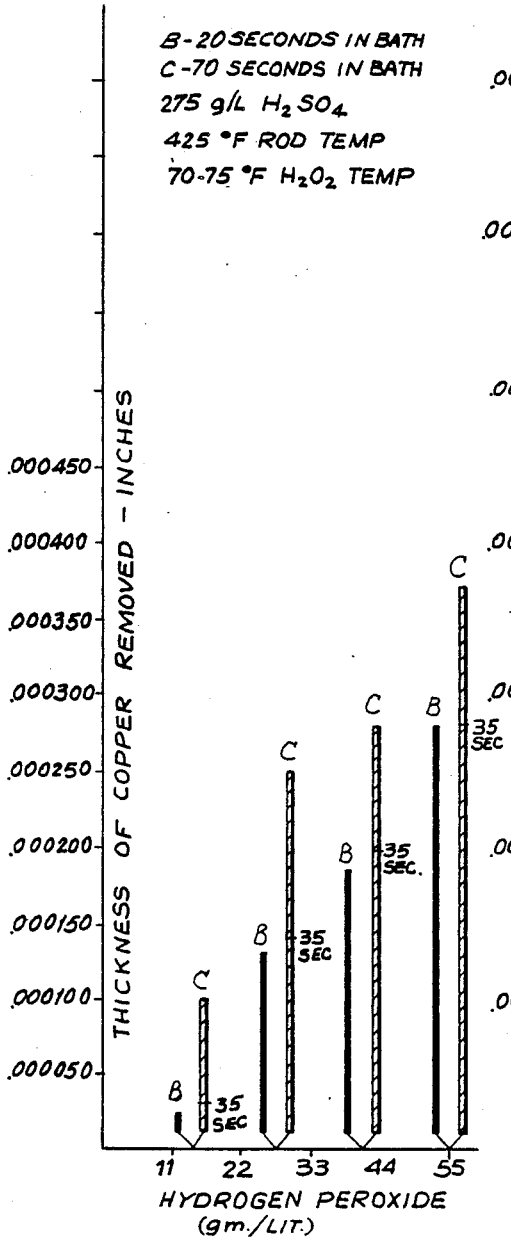
FIG. 4 is a graph showing copper removal from a polished test specimen as a function of hydrogen peroxide level with a standard sulfuric acid concentration and a further elevated rod temperature of 425° F.
Figure 5:
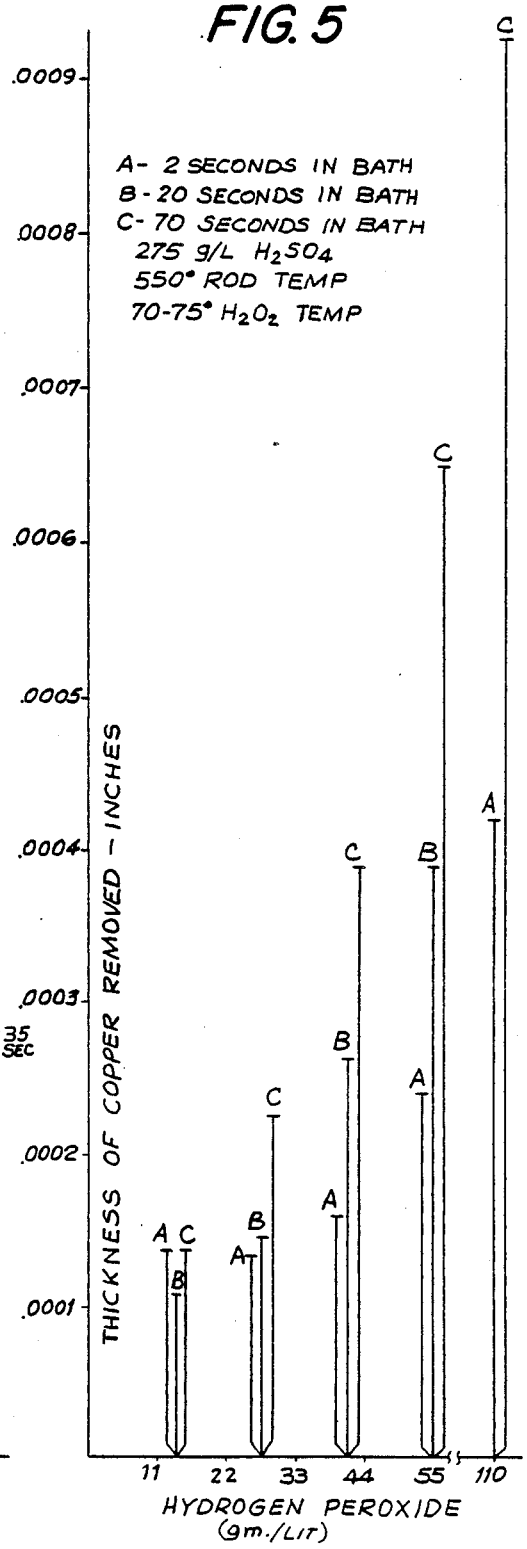
FIG. 5 is a graph showing copper removal from a polished test specimen as a function of hydrogen peroxide level with a standard sulfuric acid concentration and a still further elevated rod temperature of 550° F.

FIG. 3 is a graph like FIG. 2 except that the rod temperature entering the solution was increased to 275° F. and the solution temperature was lowered to ambient temperature (about 70°–75° F.) FIG. 3 reveals that the copper removal is proportional both to the peroxide concentration and the time of reaction. In comparison with FIG. 2, it is apparent that the entering rod temperature is a significant variable. FIGS. 4 and 5 are similar to FIG. 3 except that the entering rod temperature has been further increased respectively to 425° F. and 550° F. FIGS. 4 and 5 also demonstrate that the copper removal from the surface of the rod generally increases with an increase in peroxide concentration, time of reaction and entering rod temperature. Consistent with the general theory of chemical reactions, other work performed by applicants has demonstrated that copper removal is also enhanced by increased solution temperature.

The amount of copper that must be removed from the surface of a rod to produce a smooth, clean surface depends upon the processing history of the rod from the time it leaves the casting machine. This includes not only the particular types of rolling mills used but also the operating settings of those mills and the condition of the rolls. Thus the surface quality of the rod produced by the rolling mills may vary and will usually deteriorate over time. Although the ordinary surface quality of the rod may indicate a surface removal requirement of 0.0002 to 0.0006 inches, variations in the quality of the rod surface may change the removal requirement from as little a 0.0001 to over 0.001 inches. It will be appreciated that a skilled operator can adjust one or more of the process variables in order to produce the minimum amount of copper removal to attain a satisfactory rod quality. Such adjustments are easier and frequently more effective than attempts to adjust one or more of the stands of the rolling mills. In most instances, there are practical restraints which limit the ranges for each variable.

As shown by FIGS. 2 through 5, an increase in rod temperature or solution temperature or both will increase the rate of copper removal. Above about 500° F. the rod becomes difficult to handle because it will have softened excessively while below about 200° F., the chemical shaving reaction rates are too slow. Thus, the preferable rod temperature range is about 250° F. to about 500° F. though temperatures above and below this range can be used if the other variables are adjusted appropriately. The rod temperature can be increased by decreasing the flow of cooling water in the cooler 34. Similarly, the solution temperature in the shaving and pickling step may vary from 120° F. to about 160° F. The upper limit, in this case, is determined principally by the stability of hydrogen peroxide which tends to decompose and evaporate at elevated temperatures. Stabilized hydrogen peroxide is commercially available from several sources, including FMC Corporation, E. I. du Pont, and Interox, which will be stable up to about 160° F. and thus permit the economical use of solution temperatures in the range of 120° to 140° F. GWR Broxide C brand of stabilized hydrogen peroxide made by Interox and available through G. Whitfield Richards Company may be used in applicants' process. The saturation point of dissolved copper in a pickle solution at a temperature of 120°–160° F. is about 55–69 grams/liter and increases with the solution temperature. Above this point crystallization as hydrated copper sulfate may occur which will cause severe operating problems. Thus, the solution temperature, rod temperature and copper through-put affect the amount of solution which must be bled-off, i.e., the mass of copper being removed per hour determines the bleed-off rate.

Although the copper removal increases with hydrogen peroxide concentration, at least up to about 100 grams/liter, the peroxide losses due to decomposition and evaporation increase with both solution temperature and solution concentration. Thus, it may be impractical to exceed about 50 grams/liter concentration and economical commercial operation may be achieved with peroxide concentration in the range of 15–28 grams/liter. At levels below about 10 grams/liter the oxidizing capacity of the peroxide will be utilized essentially to oxidize the surface cuprous oxide scale and little, if any, chemical shaving will be accomplished.

The sulfuric acid concentration should be in the conventional pickling range, i.e., 180–450 grams/liter free acid and preferably 260 to 340 grams/liter free acid. Tests were performed by applicants employing machined hot-rolled rods 0.320" diameter and 2.00" length immersed in a solution of hydrogen peroxide at a concentration of 15 grams/liter and varying the concentration of sulfuric acid between 150 and 500 grams/liter free acid. The solution temperature was 135° F. while the rod temperature was 400° F. and the reaction time was 60 seconds. The thickness of copper chemically shaved from the test rods is shown in Table 1 below:

TABLE 1

| | | | | | | |
|---|---|---|---|---|---|---|
| $H_2SO_4$ concentration (gm/liter) | 150 | 200 | 250 | 300 | 350 | 350 |
| Cu thickness removed (in $\times 10^{-4}$) | 2.16 | 2.20 | 2.28 | 2.41 | 3.20 | 3.24 |

In this range of sulfuric acid concentration, cupric oxides are effectively removed and, because of the low reactivity of sulfuric acid with cuprous oxide and metallic copper, increased sulfuric acid concentration provides little improvement in the surface quality of the copper rod. At temperatures below about 120° F. the effectiveness of sulfuric acid in removing cupric oxide is substantially reduced thereby providing a practical lower limit for the solution temperature.

Determination of the surface quality of the chemically milled and pickled rod may be accomplished by using an empirical twist test known as the Three Die Twist Test, or by optical microscopic examination of the rod. The Three Die Twist Test as applied to 5/16" (0.312") rod may be performed as follows:

1. Draw a 15" sample of 0.312" rod successively through 0.289", 0.258", and 0.229" dies.
2. After cleaning and trimming, twist the sample in a conventional twist machine ten times in each direction under a 40 pound tensional load at about 20 rpm.
3. Evaluate the surface of the twisted rod specimen using a seven power stereo microscope, looking specifically for flakes, fines and cracks.

Although the evaluation step in this test is necessarily subjective to a degree, experienced operators can classify their observations within 4 or 5 different grades with acceptable repeatability. This test may be performed routinely at frequent intervals during production and used not only as a measure of quality but also as a signal to readjust one or more of the process variables so as to increase the extent of chemical shaving. It will be noted that in the Three Die Twist Test described above, the reduction in area effected by drawing was about 50%. In applying this test to other rod sizes, it is important to attain a reduction in area of about 50% so as to accomplish sufficient cold working of the rod to demonstrate the behavior of the rod in a subsequent drawing or rolling operation. The 50% reduction in area can be effected with varying numbers of dies, but the use of three dies is convenient. Variations in the mechanical twist test of the type here contemplated are described in an article by Chia, Adams and Kajuch entitled "Torsional stress tests for copper rod: indicator of quality and performance" published in *Wire Journal International* for June 1986 at pp. 57–67. An electrochemical test known as the "POPS" test capable of measuring the oxide thickness on copper rod is described in an article by Pops and Hennessy entitled "The role of surface oxide and its measurement in the copper wire industry" published in *Wire Journal* for April 1977 at pp. 50–57. While useful in the measurement of oxides, the POPS test does not measure surface smoothness and thus is not a satisfactory substitute for the mechanical twist test.

Optical microscopic examination may also be employed to determine the quality of the rod surface. However, since considerable time is required to prepare the samples for microscopy, this test is not suitable as a production control method. Microscopic examination should be conducted at 600 magnifications in order to detect the small cracks and cavities which, during drawing, become the source of copper dust or fines.

It will be appreciated that in accordance with the process of the present invention it is possible consistently to produce a hot-rolled copper rod having a surface substantially free of oxides and surface imperfections even though the casting and rolling equipment may not be adjusted and maintained to the optimum level, thereby increasing the time between scheduled maintenance shutdowns of the equipment.

The terms and expressions which have been employed are used as terms of description and not of limitation and there is no intention in the use of such terms and expressions of excluding any equivalents of the features shown and described or portions thereof, but it is recognized that various modifications are possible within the scope of this invention claimed.

What is claimed is:

1. Chemically shaved and pickled hot-rolled copper rod suitable for subsequent drawing or rolling to form copper wire and characterized by improved surface smoothness and substantial freedom from surface oxides and surface marks from mechanical machining and produced by a process comprising the steps of providing a molten bath of copper having a purity corresponding to the purity of electrolytically refined copper cathodes, casting said molten bath into cast copper bar, hot-rolling said cast copper bar to form hot-rolled copper rod, regulating the temperature of said hot-rolled copper rod within the range of 250–1,200° F., regulating the passage of said hot-rolled copper rod through an aqueous solution containing a controlled concentration of sulfuric acid within the range of 180–450 grams/liter free acid and a controlled concentration of stabilized hydrogen peroxide within the range of 5 to 50 grams/liter concentration to produce a chemically shaved and pickled hot-rolled copper rod, regulating the temperature of said aqueous solution containing sulfuric acid and stabilized hydrogen peroxide to a range of 120° and about 160° F., said passage of said hot-rolled copper rod regulated to provide a reaction time in the range of 2 seconds to 2 minutes in said aqueous solution containing sulfuric acid and stabilized hydrogen peroxide, withdrawing a sample length of said chemically shaved and pickled hot-rolled copper rod, subjecting said sample to a 3-die twist test to indicate the surface smoothness of said chemically shaved and pickled hot-rolled copper rod, and adjusting one or more of the process variables comprising the temperature of said hot-rolled copper rod, the concentration of said hydrogen peroxide in said aqueous solution, the concentration of said sulfuric acid in said aqueous solution, the time of passage of said hot-rolled copper rod through said aqueous solution and the temperature of said aqueous solution whereby the surface smoothness of said chemically shaved and pickled hot-rolled copper rod is improved, the surface oxides are substantially removed, the surface contains no marks from mechanical machining and the rod qualifies as "Class 1" when evaluated by a 3-die twist test.

2. Chemically shaved and pickled hot-rolled copper rod suitable for subsequent drawing or rolling to form copper wire and characterized by improved surface smoothness and substantial freedom from surface oxides and surface marks from mechanical machining and produced by a process comprising the steps of providing a molten bath of copper having a purity corresponding to the purity of electrolytically refined copper cathodes, casting said molten bath into cast copper bar, hot-rolling said cast copper bar to form hot-rolled copper rod, regulating the temperature of said hot-rolled copper rod within the range of 250°–500° F., coiling said hot-rolled copper rod into a coil comprising a plurality of loops, separating said loops of hot-rolled copper rod from said coil, regulating the passage of said separated loops of hot-rolled copper rod through an aqueous solution containing sulfuric acid at a concentration in the range of 180 to 450 grams/liter free acid and a controlled concentration of stabilized hydrogen peroxide within the range of 5 to 50 grams/liter concentration to produce a chemically shaved and pickled hot-rolled copper rod, regulating the temperature of said aqueous solution containing sulfuric acid and stabilized hydrogen peroxide to a range between 120° and about 160° F., said passage of said separated loops of hot-rolled copper rod regulated to provide a reaction time in the range of 2 seconds to 2 minutes in said aqueous solution containing sulfuric acid and stabilized hydrogen peroxide, withdrawing a sample length of said chemically shaved and pickled hot-rolled copper rod, subjecting said sample to a 3-die twist test to indicate the surface smoothness of said chemically shaved and pickled hot-rolled copper rod, and adjusting one or more of the process variables comprising the temperature of said hot-rolled copper rod, the concentration of said hydrogen peroxide in said aqueous solution, the concentration of said sulfuric acid in said aqueous solution, the time of passage of said separated loops through said aqueous solution and the temperature of said aqueous solution whereby the surface smoothness of said chemically shaved and pickled hot-rolled copper rod is improved, the surface oxides are substantially removed, the surface contains no marks from mechanical machining and the rod qualifies as "Class 1" when evaluated by a 3-die twist test.

3. Chemically shaved and pickled hot-rolled copper rod suitable for subsequent drawing or rolling to form copper wire and characterized by improved surface smoothness and substantial freedom from surface oxides and surface marks from mechanical machining comprising the steps of providing a molten bath of copper having a purity corresponding to the purity of electrolytically refined copper cathodes, continuously casting said molten bath into cast copper bar, hot-rolling said continuously cast copper bar to form hot-rolled copper rod, coiling said hot-rolled copper rod into a coil comprising a plurality of loops, separating said loops of continuously cast hot-rolled copper rod from said coil, regulating the temperature of said copper loops within the range of 250°–500° F., regulating the passage of said separated loops of continuously cast hot-rolled copper loops through an aqueous solution containing a concentration of sulfuric acid in the range of 260–340 grams/liter free acid and a controlled concentration of stabilized hydrogen peroxide within the range of 15 to 28 grams per liter to produce a chemically shaved and pickled hot-rolled copper rod, regulating the temperature of said aqueous solution containing sulfuric acid and stabilized hydrogen peroxide to a range between 120° and 140° F., said passage of said separated loops of hot-rolled copper rod regulated to provide a reaction time in the range of 2 seconds to 2 minutes in said aqueous solution containing sulfuric acid and stabilized hydrogen peroxide, withdrawing a sample length of said chemically shaved and pickled hot-rolled copper rod, subjecting said sample to a 3-die twist test to indicate the surface smoothness of said chemically shaved and pickled hot-rolled copper rod, and adjusting one or more of the process variables comprising the temperature of said hot-rolled copper rod, the concentration of said hydrogen peroxide in said aqueous solution, the concentration of sulfuric acid in said aqueous solution, the time of passage of said separated loops through said aqueous solution and the temperature of said aqueous solution whereby the surface smoothness of said chemically shaved and pickled hot-rolled copper rod is improved, the surface oxides are substantially removed, the surface contains no marks from mechanical machining and the rod qualifies as "Class 1" when evaluated by a 3-die twist test.

4. Chemically shaved and pickled hot-rolled copper rod as set forth in claim 2 in which said molten bath of copper is continuously cast into copper bar.

5. Chemically shaved and pickled hot-rolled copper rod as set forth in claim 2 in which the concentration of the said hydrogen peroxide in said aqueous solution is within the range of 15 to 28 grams per liter.

6. Chemically shaved and pickled hot-rolled copper rod as set forth in claim 2 in which the concentration of the said sulfuric acid in said aqueous solution is within the range of 260 to 340 grams/liter free acid.

7. Chemically shaved and pickled hot-rolled copper rod as set forth in claim 2 in which the temperature of said aqueous solution is within the range of 120°-140° F.

* * * * *